US005755051A

United States Patent [19]

Zumbuhl

[11] Patent Number: 5,755,051

[45] Date of Patent: May 26, 1998

[54] WARNING LIGHT AND SIGN APPARATUS

[76] Inventor: Edward J. Zumbuhl, P.O. Box 526, Morton, Wash. 98356

[21] Appl. No.: 759,262

[22] Filed: Dec. 2, 1996

[51] Int. Cl.[6] ..... G09F 21/02

[52] U.S. Cl. ..... 40/586; 40/607; 40/612; 340/908

[58] Field of Search ..... 40/553, 564, 572, 40/586, 606, 612, 607; 340/321, 473, 815.73, 515.74, 815.76, 908; 362/183

[56] References Cited

U.S. PATENT DOCUMENTS

| | | | |
|---|---|---|---|
| D. 351,807 | 10/1994 | Smith et al. . | |
| 1,583,410 | 5/1926 | Mastin | 40/586 X |
| 2,409,957 | 10/1946 | Reynolds | 340/908 |
| 3,435,412 | 3/1969 | Bohrer, Sr. | 340/908 |
| 3,810,091 | 5/1974 | Hoover | 340/908 X |
| 3,821,860 | 7/1974 | Patty | 340/908 X |
| 4,042,919 | 8/1977 | Patty | 340/321 |
| 4,074,252 | 2/1978 | Keller . | |
| 4,090,186 | 5/1978 | Renner | 340/321 |
| 4,357,648 | 11/1982 | Nelson | 362/183 |
| 4,922,223 | 5/1990 | Prevot | 340/473 |
| 5,023,607 | 6/1991 | Staten | 40/612 X |
| 5,097,612 | 3/1992 | Williams | 40/591 |
| 5,276,424 | 1/1994 | Hegemann | 340/321 |
| 5,440,464 | 8/1995 | Nowlin et al. | 340/908 X |

*Primary Examiner*—Brian K. Green

[57] ABSTRACT

A warning light and sign apparatus includes a handle assembly which includes a top end and a bottom end. A sign-receiving bracket assembly is supported by the top end of the handle assembly. A bracket-supported light assembly is supported by sign-receiving bracket assembly. A power supply assembly is supported by the handle assembly and is electrically connected to the bracket-supported light assembly. A sign is received by the sign-receiving bracket assembly. The sign includes a first message "stop" on a first side and includes a second message "slow" on a second side. The handle assembly can be easily rotated 180 to selectively orient either the "stop" message or the "slow" message. Removable sign-to-light fasteners connect the sign to the bracket-supported light assembly. The sign-receiving bracket assembly includes a front bracket portion and a rear bracket portion, and a bottom portion of the sign is received between the front bracket portion and the rear bracket portion. The bracket-supported light assembly includes a front bracket-supported light portion and a rear bracket-supported light portion, and a portion of the sign is received between the front bracket-supported light portion and the rear bracket-supported light portion. In addition, another light assembly may be supported by the sign. A handle extension assembly is screwed onto the bottom end of the handle assembly. The power supply assembly can include rechargeable batteries, and a recharger unit can be employed to recharge the batteries.

13 Claims, 3 Drawing Sheets

WARNING LIGHT AND SIGN APPARATUS

BACKGROUND OF THE INVENTION

1. Field of the Invention

The present invention relates generally to warning lights and signs and, more particularly, to hand-held warning lights and signs.

2. Description of the Prior Art

Hand-held warning lights can serve an important safety function. When a sign is added to a hand-held warning light, important information can be added to the warning that is communicated by the warning light. In this respect, throughout the years, a number of innovations have been developed relating to hand-held warning lights accompanied by signs, and the following U.S. patents are representative of some of those innovations: U.S. Pat. Nos. 4,042,919, 4,074,252, 4,922,223, 5,097,612, 5,276,424, and Des. 351,807. More specifically, each of the above-cited patents discloses a warning light and sign apparatus that has a single sign associated with the warning lights. However, there are occasions when one sign would be more appropriate than another. For example, some traffic conditions may warrant a red flashing light and a sign that requests vehicles to stop. Other traffic conditions may warrant a yellow flashing light and a sign that requests vehicles to slow down. In this respect, it would be desirable if a warning light and sign device were provided which permits different signs and different colored lights to be selected. More specifically, it would be desirable if a warning light and sign device were provided which permits a selection of a "stop" sign with a red warning light or a "slow" sign with a yellow warning light.

Also, each of the above-cited patents appears to disclose a respective device in which one sign is permanently attached to a warning light. There may be times, however, when it would be desirable to change the sign and substitute with another sign. Such a change would be very difficult with the devices disclosed in the above-cited patents. In this respect, it would be desirable if a warning light and sign device were provided which permits one sign to be substituted for another sign easily.

Still other features would be desirable in a warning light and sign device. For example, a relatively short handle for a hand-held device may be suitable for many occasions. However, there may be other times when it would be desirable for the warning light and sign to be seen at greater distances. To do so, it would be desirable if the warning light and sign could be raised to an elevated height while still being hand-held.

Simply holding a hand-held warning light and sign may become a tedious task, especially if it is necessary to hold the warning light and sign for an extended period of time. In this respect, it would be desirable if a warning light and sign device were provided which permits the device to be readily controlled by a person's hand, yet does not require the person's hand to bear the entire weight of the device.

Hand-held warning light and sign devices are generally battery powered to enhance portability. It is desirable for the batteries to be rechargeable. In this respect, it may be desirable if a rechargeable battery pack were provided which could be recharged without removing the batteries from the warning light and sign device. To recharge the batteries, it would be desirable if the battery charger could receive charging power from a truck mounted battery charger.

Thus, while the foregoing body of prior art indicates it to be well known to use hand-held warning light and sign devices, the prior art described above does not teach or suggest a warning light and sign apparatus which has the following combination of desirable features: (1) permits different signs and different colored lights to be selected; (2) permits a selection of a "stop" sign with a red warning light or a "slow" sign with a yellow warning light; (3) permits easy substitution of one sign for another; (4) can be raised to an elevated height while still being hand-held; (5) permits the device to be readily controlled by a person's hand, yet does not require the person's hand to bear the entire weight of the device; (6) provides a rechargeable battery pack which can be recharged without removing the batteries from the warning light and sign apparatus; and (7) can receive charging power from a truck mounted battery charger. The foregoing desired characteristics are provided by the unique warning light and sign apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a warning light and sign apparatus which includes a handle assembly which includes a top end and a bottom end. A sign-receiving bracket assembly is supported by the top end of the handle assembly. A bracket-supported light assembly is supported by sign-receiving bracket assembly. A power supply assembly is supported by the handle assembly and electrically is connected to the bracket-supported light assembly. A sign is received by the sign-receiving bracket assembly. The sign includes a first message on a first side and includes a second message on a second side. The first message indicates "stop", and the second message indicates "slow". The handle assembly and the sign-receiving bracket assembly are formed as a single, unified structure. Sign-to-light fasteners connect the sign to the bracket-supported light assembly.

The sign-receiving bracket assembly includes a front bracket portion and a rear bracket portion, and a bottom portion of the sign is received between the front bracket portion and the rear bracket portion. The bracket-supported light assembly includes a front bracket-supported light portion and a rear bracket-supported light portion, and a portion of the sign is received between the front bracket-supported light portion and the rear bracket-supported light portion.

A sign-supported light assembly is supported by the sign. The sign-supported light assembly includes a front sign-supported light portion and a rear sign-supported light portion, and a portion of the sign is sandwiched between the front sign-supported light portion and the rear sign-supported light portion.

A handle extension assembly is connected to the bottom end of the handle assembly. The bottom end of the handle assembly includes a first threaded portion. A top end of the handle extension assembly includes a second threaded portion, and the first threaded portion and the second threaded portion are complementary.

A recharger jack is electrically connected to the power supply assembly, and a recharger assembly selectively electrically connected to the recharger jack. The recharger assembly includes a plug for electrical connection to the recharger jack, recharger conductors electrically connected to the plug, and a recharger unit electrically connected to the recharger conductors. The recharger unit is adapted to connect electrically with a recharging power source, such as a truck mount for a recharger. The recharger assembly further includes a pair of connector straps connected to the recharger unit.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved warning light and sign apparatus which has all of the advantages of the prior art and none of the disadvantages.

It is another object of the present invention to provide a new and improved warning light and sign apparatus which may be easily and efficiently manufactured and marketed.

It is a further object of the present invention to provide a new and improved warning light and sign apparatus which is of durable and reliable construction.

An even further object of the present invention is to provide a new and improved warning light and sign apparatus which is susceptible of a low cost of manufacture with regard to both materials and labor, and which accordingly is then susceptible of low prices of sale to the consuming public, thereby making such warning light and sign apparatus available to the buying public.

Still yet a further object of the present invention is to provide a new and improved warning light and sign apparatus which permits different signs and different colored lights to be selected.

Still another object of the present invention is to provide a new and improved warning light and sign apparatus that permits a selection of a "stop" sign with a red warning light or a "slow" sign with a yellow warning light.

Yet another object of the present invention is to provide a new and improved warning light and sign apparatus which permits easy substitution of one sign for another.

Even another object of the present invention is to provide a new and improved warning light and sign apparatus that can be raised to an elevated height while still being hand-held.

Still a further object of the present invention is to provide a new and improved warning light and sign apparatus which permits the device to be readily controlled by a person's hand, yet does not require the person's hand to bear the entire weight of the device.

Yet another object of the present invention is to provide a new and improved warning light and sign apparatus that provides a rechargeable battery pack which can be recharged without removing the batteries from the warning light and sign apparatus.

Still another object of the present invention is to provide a new and improved warning light and sign apparatus which can receive charging power from a track mounted battery charger.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
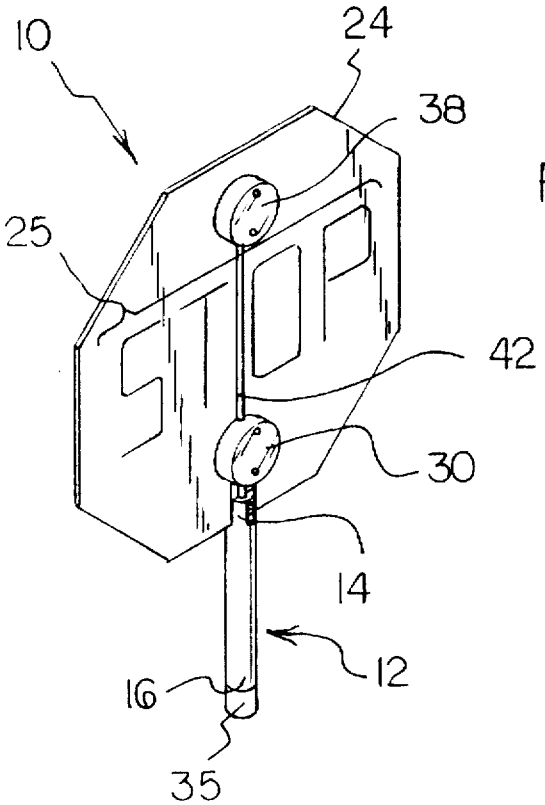
FIG. 1 is a front perspective view showing a first embodiment of the warning light and sign apparatus of the invention with a "stop" side of a sign showing.
Figure 2:
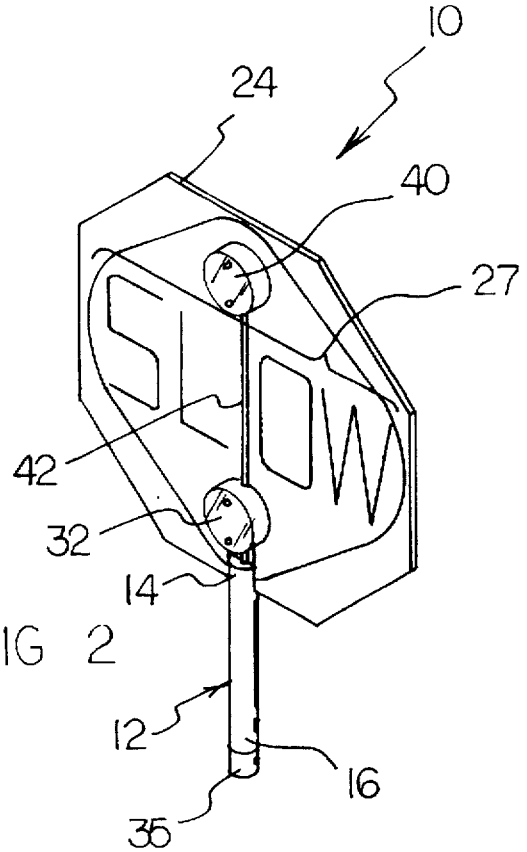
FIG. 2 is a back perspective view showing the first embodiment of the warning light and sign apparatus of the invention with a "slow" side of a sign showing.

With reference to the drawings, a new and improved warning light and sign apparatus embodying the principles and concepts of the present invention will be described.

Turning to FIGS. 1–4, a first embodiment of the warning light and sign apparatus 10 of the invention is shown. More specifically, the warning light and sign apparatus 10 includes a handle assembly 12 which includes a top end 14 and a bottom end 16. A sign-receiving bracket assembly 18 is supported by the top end 14 of the handle assembly 12. A bracket-supported light assembly 20 is supported by sign-receiving bracket assembly 18. A power supply assembly 22 is supported by the handle assembly 12 and is electrically connected to the bracket-supported light assembly 20. A sign 24 is received by the sign-receiving bracket assembly 18. The sign 24 includes a first message 25 on a first side and includes a second message 27 on a second side. The first message 25 indicates "stop", and the second message 27 indicates "slow". The handle assembly 12 and the sign-receiving bracket assembly 18 are formed as a single, unified structure. Sign-to-light fasteners connect the sign 24 to the bracket-supported light assembly 20. The sign-to-light fasteners can be in the form of bolts 34.

The sign-receiving bracket assembly 18 includes a front bracket portion 26 and a rear bracket portion 28, and a bottom portion of the sign 24 is received between the front bracket portion 26 and the rear bracket portion 28. The bracket-supported light assembly 20 includes a front bracket-supported light portion 30 and a rear bracket-supported light portion 32, and a portion of the sign 24 is received between the front bracket-supported light portion 30 and the rear bracket-supported light portion 32. Light bulbs 37 are shown in each of the bracket-supported light portions.

A sign-supported light assembly is supported by the sign 24. The sign-supported light assembly includes conductors 42 which are electrically connected to the power supply assembly 22. The sign-supported light assembly includes a front sign-supported light portion 38 and a rear sign-supported light portion 40, and a portion of the sign 24 is sandwiched between the front sign-supported light portion 38 and the rear sign-supported light portion 40.

Figure 3:
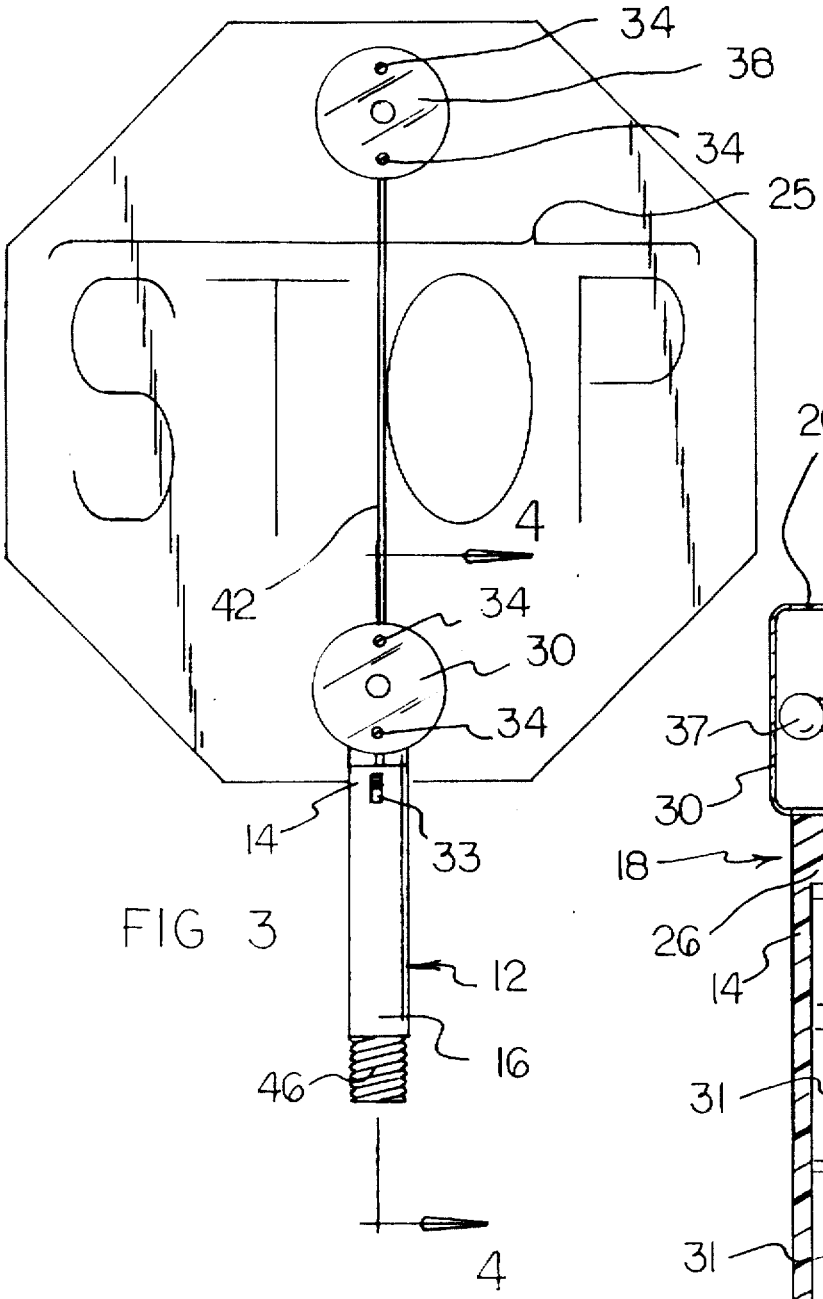
FIG. 3 is an enlarged front view of the embodiment of the warning light and sign apparatus of FIG. 1 with a threaded cap removed from the bottom of a handle portion.
Figure 4:
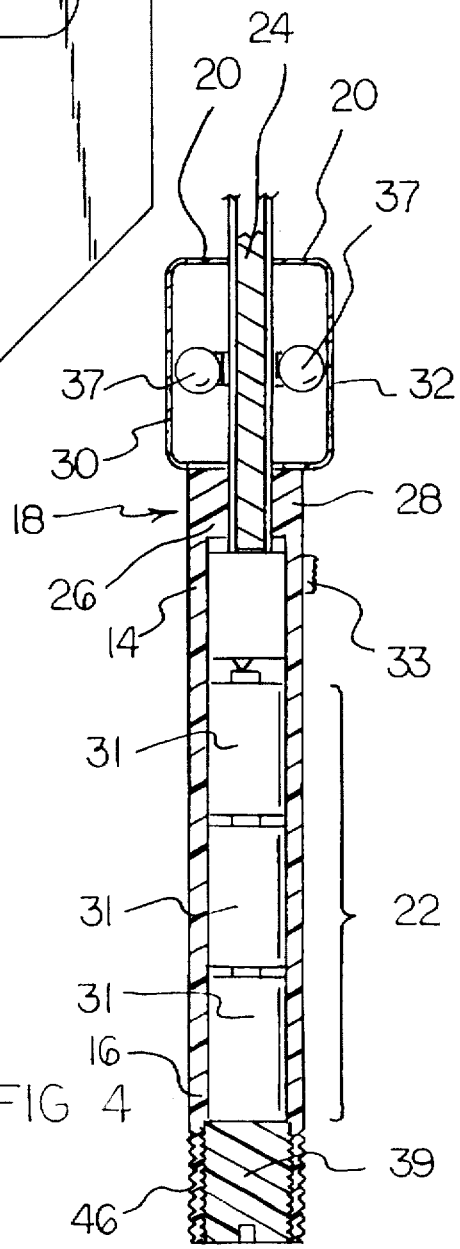
FIG. 4 is a partial cross-sectional view of the embodiment of the invention shown in FIG. 3 taken along line 4—4 thereof.
Figures 5, 6:
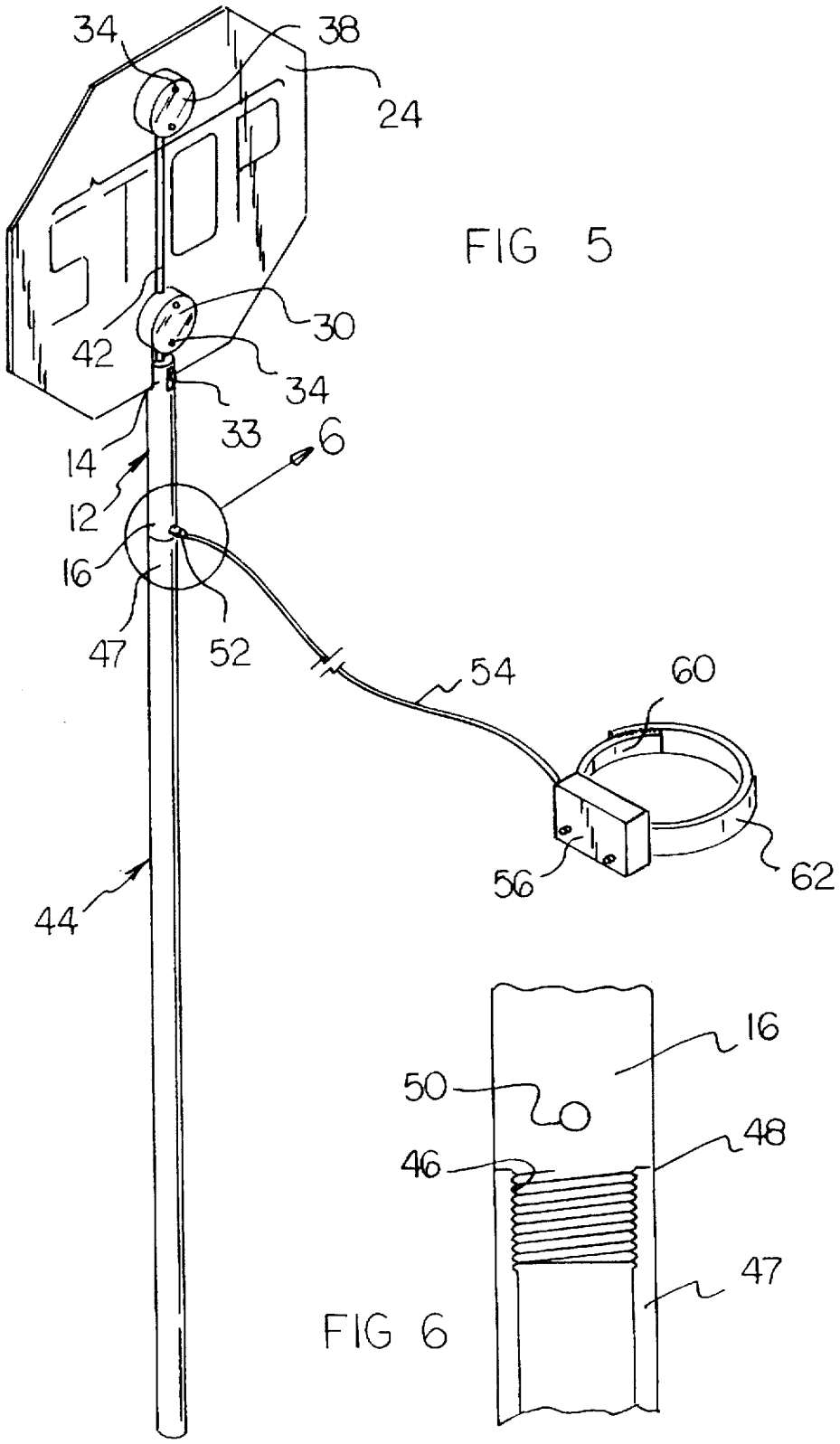
FIG. 5 is a perspective view of a second embodiment of the invention which includes a handle extension assembly.
FIG. 6 is an enlarged view of a portion of the embodiment of the invention shown in FIG. 5 in the circled region 6 thereof.

A second embodiment of the invention is shown in FIGS. 5 and 6, in which handle extension assembly 44 is connected to the bottom end 16 of the handle assembly 12. The bottom end 16 of the handle assembly 12 includes a first threaded portion 46. A top end 47 of the handle extension assembly 44 includes a second threaded portion 48, and the first threaded portion 46 and the second threaded portion 48 are complementary. It is noted that in FIGS. 1 and 2, the bottom end 16 of the handle assembly 12 can be equipped with a threaded cap 35. The threaded cap 35 is removed to gain access to the first threaded portion 46, on the handle assembly 12, to permit the second threaded portion 48, on the handle extension assembly 44, to be screwed onto the first threaded portion 46. As shown in FIG. 3, the first threaded portion 46 is externally threaded. In this respect, the second threaded portion 48 of the handle extension assembly 44 is internally threaded and is screwed onto the first threaded portion 46.

Either embodiment of the invention can also include recharger jack 50 electrically connected to the power supply assembly 22, and a recharger assembly selectively electrically connected to the recharger jack 50. The recharger assembly includes a plug 52 for electrical connection to the recharger jack 50, recharger conductors 54 electrically connected to the plug 52, and a recharger unit 56 electrically connected to the recharger conductors 54. The recharger unit 56 is adapted to connect electrically with a recharging power source, such as a truck mount for a recharger.

The recharger assembly further includes a pair of connector straps connected to the recharger unit 56. The pair of connector straps includes a first strap 60 which has a first quantity of hook-or-loop connector material and a second strap 62 which has a quantity of complimentary loop-or-hook material. The first strap 60 and the second strap 62 can be made from rubber materials, such as NEOPRENE(TM). Well known VELCRO(TM) material can be used for the hook and loop containing materials.

With either embodiment of the invention, a number of batteries 31, preferably rechargeable batteries, are part of the power supply assembly 22 and are placed inside a hollow handle assembly 12. The batteries 31 are in an electrical circuit with other circuit components which include an on/off switch 33, the front bracket-supported light portion 30, the rear bracket-supported light portion 32, the conductors 42, the front sign-supported light portion 38, and the rear sign-supported light portion 40. The bracket-supported light assembly 20 can include a flasher module (not shown) which permits each of the front bracket-supported light portion 30 and the rear bracket-supported light portion 32 to provide a flashing light. Alternatively, each bracket-supported light portion can have its own flasher module. Moreover, the front sign-supported light portion 38 and the rear sign-supported light portion 40 can also be connected to the flasher module so that the light which emanates from those lights is a flashing light. Or, each sign-supported light portion can have its own flasher module.

When the batteries 31 in the power supply assembly 22 are to be recharged, the plug 52 of the recharger assembly is plugged into the recharger jack 50. In addition, the recharger unit 56 is plugged into a suitable recharging power source, such as a truck mount for a recharger. To stabilize the recharger unit 56, the first strap 60 and the second strap 62 can be positioned to encompass a rigid member, such as a steering post, and the VELCRO(TM) fasteners can be used to secure the straps to the rigid member.

More specifically with respect to the second embodiment of the invention, when the handle extension assembly 44 is installed on the handle assembly 12, the bottom portion of the handle extension assembly 44 can be rested on a street surface which can bear most of the weight of the warning light and sign apparatus 10. A user's hand can still control operation of the invention.

In using either embodiment of the warning light and sign apparatus 10, the on/off switch 33 can be turned on to permit the bracket-supported light assembly 20 and the sign-supported light assembly to flash. At the will of the user of the invention, the second message 27, such as "slow", can be oriented to face an oncoming stream of traffic. Then, at the will of the user, the sign 24 can be rotated 180 degrees, and the first message 25, such as "stop", can be oriented to face the oncoming traffic. If desired, either in use or for purposes of storage, the bolts 34 can be removed, and the sign 24 can readily be removed or replaced. Also, for purposes of storage, the handle extension assembly 44 can be unscrewed from the handle assembly 12, and the threaded cap 35 can be screwed onto the end of the handle assembly 12. It is further noted that a threaded plug 39 can be used in order to gain access to the batteries 31 inside the hollow handle assembly 12.

The components of the warning light and sign apparatus of the invention can be made from inexpensive and durable rubber, metal, and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved warning light and sign apparatus that is low in cost, relatively simple in design and operation, and which may advantageously be used to permit different signs and different colored lights to be selected. With the invention, a warning light and sign apparatus is provided which permits a selection of a "stop" sign with a red warning light or a "slow" sign with a yellow warning light. With the invention, a warning light and sign apparatus is provided which permits easy substitution of one sign for another. With the invention, a warning light and sign apparatus is provided which can be raised to an elevated height while still being hand-held. With the invention, a warning light and sign apparatus is provided which permits the device to be readily controlled by a person's hand, yet does not require the person's hand to bear the entire weight of the device. With the invention, a warning light and sign apparatus provides a rechargeable battery pack which can be recharged without removing the batteries from the warning light and sign apparatus. With the invention, a warning light and sign apparatus is provided which can receive charging power from a truck mounted battery charger.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by LETTERS PATENT of the united states is as follows:

1. A warning light and sign apparatus, comprising:

a handle assembly which includes a top end and a bottom end, the bottom end having an exterior threaded portion and an interior threaded portion, the handle assembly having a longitudinal length, a sign-receiving bracket assembly supported by said top end of said handle assembly, a bracket-supported light assembly supported by the sign-receiving bracket assembly, a power supply assembly supported by said handle assembly and electrically connected to said bracket-supported light assembly, the power supply assembly including at least one battery positioned within the handle assembly and an externally-threaded plug positioned within the bottom end of the handle assembly, the externally-threaded slur being threadably engaged with the interior threaded portion of the handle assembly, and a sign received by said sign-receiving bracket assembly, a handle extension assembly having a longitudinal length greater than the longitudinal length of the handle assembly, the handle extension assembly having a top end with an interior threaded portion, the interior threaded portion of the top end of the handle extension assembly being removably and threadably engaged to the exterior threaded portion of the handle assembly so as to co-linearly couple the handle extension assembly to the handle assembly.

2. The apparatus of claim 1 wherein said sign includes a first message on a first side and includes a second message on a second side.

3. The apparatus of claim 2 wherein said first message indicates "stop" and said second message indicates "slow".

4. The apparatus of claim 1 wherein said handle assembly and said sign-receiving bracket assembly are formed as a single, unified structure.

5. The apparatus of claim 1, further including:

sign-to-light fasteners for connecting said sign to said bracket-supported light assembly.

6. The apparatus of claim 1 wherein:

said sign-receiving bracket assembly includes a front bracket portion and a rear bracket portion, and a bottom portion of said sign is received between said front bracket portion and said rear bracket portion.

7. The apparatus of claim 1 wherein:

said bracket-supported light assembly includes a front bracket-supported light portion and a rear bracket-supported light portion, and a portion of said sign is received between said front bracket-supported light portion and said rear bracket-supported light portion.

8. The apparatus of claim 1, further including:

a sign-supported light assembly supported by said sign.

9. The apparatus of claim 8 wherein:

said sign-supported light assembly includes a front sign-supported light portion and a rear sign-supported light portion, and a portion of said sign is sandwiched between said front sign-supported light portion and said rear sign-supported light portion.

10. The apparatus of claim 1, further including:

a recharger jack electrically connected to said power supply assembly, and a recharger assembly selectively electrically connected to said recharger jack.

11. The apparatus of claim 10 wherein said recharger assembly includes:

a plug for electrical connection to said recharger jack, recharger conductors electrically connected to said plug, and a recharger unit electrically connected to said recharger conductors.

12. The apparatus of claim 11 wherein said recharger unit is adapted to connect electrically with a truck mount for a recharger.

13. The apparatus of claim 11 wherein said recharger assembly further includes a pair of connector straps connected to said recharger unit.

* * * * *